US005213623A

United States Patent [19]

Burtner

[11] Patent Number: 5,213,623

[45] Date of Patent: May 25, 1993

[54] PROCESS FOR CLEANING NITRIC ACID ABSORPTION COLUMN COILS

[76] Inventor: Gerald G. Burtner, P.O. Box 80786, Baton Rouge, La. 70898

[21] Appl. No.: 682,102

[22] Filed: Apr. 5, 1991

[51] Int. Cl.[5] ..... B08B 9/04

[52] U.S. Cl. ..... 134/8; 134/22.11; 134/22.12; 15/104.061

[58] Field of Search ..... 134/7, 8, 22.12, 22.11, 134/34, 3; 15/104.061

[56] References Cited

U.S. PATENT DOCUMENTS

| | | | |
|---|---|---|---|
| 2,906,650 | 9/1959 | Wheaton | 134/8 |
| 3,135,322 | 6/1964 | Neugebauer | 134/8 |
| 3,531,813 | 10/1970 | Hurst | 15/104.062 |
| 3,879,790 | 4/1975 | Girard | 15/104.061 |
| 4,016,620 | 4/1977 | Powers | 15/104.061 |
| 4,554,965 | 11/1985 | Bochinski et al. | 134/8 |
| 4,720,884 | 1/1988 | Ralls | 15/104.061 |
| 4,724,007 | 2/1988 | Barry et al. | 134/8 |
| 4,825,498 | 5/1989 | Rankin | 15/104.061 |
| 4,846,259 | 7/1989 | Fujimoto et al | 134/8 |

*Primary Examiner*—Theodore Morris
*Assistant Examiner*—Saeed Chaudhry
*Attorney, Agent, or Firm*—Wlliam David Kiesel; Robert C. Tucker

[57] ABSTRACT

A method of cleaning a nitric acid absorption column cooling coil having an access port and an exit port comprising the steps of closing the access port, inserting a pig in an operative position within a sealable cavity of a launching assembly that is operatively attached to the access port to allow the pig to enter the coil, pressurizing the launching assembly with a fluid to a pre-determined level, opening the access port while maintaining pressure against the pig during its passage through the coil by a fluid pump sufficient to force the pig into and through the coil, and capturing the pig after it passes through the exit port.

7 Claims, 5 Drawing Sheets

PROCESS FOR CLEANING NITRIC ACID ABSORPTION COLUMN COILS

BACKGROUND OF THE INVENTION

1. Field of the Invention

This invention relates in general to methods and apparatus for cleaning absorption columns, and more particularly, to methods and apparatus for cleaning nitric acid absorption columns.

2. Prior Art

In many industrial processes it is desirable to treat a dilute (20%) nitric acid stream to form a more concentrate (typically 59%, 70%, or 92%) nitric acid stream. This is accomplished through the use of an absorption column. Typically, such columns may be up to 200 feet tall and 10–15 feet in diameter. There will be a sparger assembly at the top of the column to introduce the dilute nitric acid, and a sparger assembly at the bottom of the column to introduce nitrous gases. Inside the column will be a series of bubble caps or sieve trays wherein each tray holds multiple rows of coils and within each row are multitudes of three-quarter inch or one and one-quarter inch diameter cooling coils. The number of coils per tray will vary depending on the cooling requirements of the column and may depend on such parameters as feed stock and column design. Typically, there are 4–36 coils per tray and 24–48 trays in a column. These cooling coils loop around the bubble caps located on the trays inside the tower and are designed to cool the liquids and gases passing through the tower. To accomplish this, water is pumped from a distant cooling tower into a vertical inlet or supply header standing beside the tower. Horizontal branches or nozzles are located on the header opposite the coil ends protruding from the sidewall of the tower, and the water is introduced into the coils via connecting hoses between the inlet header nozzles and the inlet ends of the coils. The water then flows through the coil and exits out of the tower, through return hoses into the vertical return header nozzles, and then finally back to the water cooling tower. Water is the usual cooling fluid circulated in the coils, although chilled brine may be used, particularly in the upper section of the column.

Because the efficiency of the absorption tower depends upon control of the heat of reaction taking place within the column it is important that one can control the amount of water circulating within the coils. However, several problems occur which can restrict the control of water flowing through the coils. It is not uncommon that wood splinters and other solid particles in the water cooling tower enter the water stream circulating within the coils. When this happens, it is possible for a coil or coils to become partially or completely plugged. In addition, the coils may develop leaks which allow nitric acid to enter the water stream and flow back to the water tower. When this acidic contamination to the cooling water system occurs, it is usual to add a base or alkaline material to the water to neutralize the effects of the acid on other parts of the water cooling system. The reaction of alkaline and acid in turn results in the formation of precipitates such as iron that will coagulate and, eventually, partially or completely plug various coils within the absorption tower. Finally, iron corrosion may develop and expand within the iron supply and return header nozzles which effectively restricts flow through the coils.

After a period of time it becomes necessary to repair leaking coils, as well as to clean out the plugged coils and header nozzles. The two most common methods of cleaning out the plugged coils include: (i) accessing the coils one at a time from outside of the column and trying to blow air or fluid through the coil under sufficient pressure to force out any material causing a blockage, and (ii) acid treating the coils by pumping acid through all of the coils at one time. Both methods have significant drawbacks. First is that both require a shutdown of the absorption tower for long periods of time while the repairs and cleaning are being carried out. Shutting down the absorption column effectively shuts down the nitric train because federal environmental air emissions regulations would prohibit the air emissions that would occur if the nitric train was not shut down. There may be 300–800 parallel coils within the column. In addition, each coil will contain multiple bends. Thus, the distance the entrapped air and reaction gases within the coils must flow to be displaced is great. This requires the use of acid in large volumes and under high pressures to flush the coils. Even then there is no assurance of opening the plugged coils a the acid will only seek the path of least resistance. Pumping through all the tubes at once results in the necessity of using large pumps, and creates a dangerous operation because of the possibility that connecting hoses, particularly if they are old hoses, may be blown off by the pressure. As a result of feeding so many coils in parallel, it is common that after an attempted acid cleaning, a substantial amount of acidic sludge may accidentally remain in the coils which then may be difficult to remove.

Testing for leaks on stream creates additional problems, not the least of which is that in many cases it is not readily apparent where a particular leaking coil is located, nor where its outlet exits the column. Thus, to plug-off a particular leaking coil requires that one first determine where the particular coil exits. One method used is extracting liquid samples through hypodermic needle syringes inserted into the return hoses. This can be a very time consuming task when the tower is on-stream, considering that there may be up to 36 coils per tray, and as many as 48 trays per column.

OBJECTS AND SUMMARY OF THE INVENTION

Therefore one object of this invention is to provide a reliable method and apparatus for cleaning absorption column coils.

Another object of this invention is to provide a hydrostatic test method and apparatus for determining if an absorption column coil has a leak.

Still another object of this invention is to provide a method and apparatus for cleaning absorption column coils which do not require the shutdown of the use of the absorption column during the cleaning operation.

A still further object of this invention is to provide a method and apparatus for determining if an absorption column coil has a leak which does not require the shutdown of the use of the absorption column during the check.

Another further object of this invention is to provide a method and apparatus for quickly and safely cleaning absorption column coils or for determining if any of the coils has a leak.

A still further object of this invention is to provide a method and apparatus for quickly and safely cleaning the absorption column water supply manifold, header, and header hoses and water return manifold, header, and header hoses.

Other objects and advantages of the invention will become apparent from the ensuing descriptions of the invention.

Accordingly, a cleaning assembly for cleaning an absorption column coil, having an access port and an exit port located outside of the absorption column, is provided comprising: a pig; a launching assembly comprising a cylindrical chamber having a sealable opening sufficient to allow the pig to be placed in a cavity formed by the walls of the chamber, wherein the cavity is sized to hold the pig, and one end of the cavity is operatively connectable to the coil to allow the pig to move from the cavity through the access port to within the coil; a pump operatively attached to a fluid source and to the launching assembly to provide fluid to the cavity at a pre-determined pressure; and, a pressure relief valve operatively attached to the pump to prevent pressure within the chamber from exceeding the predetermined pressure.

In an alternate embodiment, a pig utilized for cleaning an absorption column coil is provided comprising: a substantially, cylindrical-shaped body constructed of compressible material, wherein one end of said body is conically-shaped and whose diameter is about 1/16 of an inch longer than the inside diameter of the coil; and a band of wire brush spirally wrapped about a portion of the body.

In another alternate embodiment, of the invention a method of cleaning an absorption column coil, having an access port and an exit port, is provided comprising: closing said access port; inserting a pig in an operative position within a sealable cavity of a launching assembly which is operatively attached to said access port to allow the pig to enter within the coil; pressurizing the launching assembly with a fluid to a pre-determined level; opening the access port while maintaining pressure by a fluid pump in the launching assembly sufficient to force the pig into and through the coil; and, capturing the pig after it passes through the exit port.

In another alternate embodiment, an apparatus is provided for cleaning the cooling fluid supply manifold headers and header hoses and the cooling fluid return manifold headers and header hoses which comprises: a flexible hose; a hollow tube operatively attached to one end of the flexible hose to allow high pressure water or similar liquid to pass from the flexible hose through the hollow tube and exit through reverse direction orifices of a nozzle attached to the hollow tube; and, a valve means operatively attached to the opposite end of the flexible hose to control the amount of high pressure water passing through the flexible hose and operatively attachable to a high pressure water supply.

In a still other alternate embodiment, a method is provided to clean the cooling fluid supply manifold headers and header hoses and the cooling fluid return manifold headers and header hoses comprising the steps of: operatively connecting a valve means to a high pressure water or similar fluid supply to control the amount of high pressure water or similar fluid flowing through the valve means and into a flexible hose which has been operatively connected to the valve means to receive the high pressure water; operatively attaching a hollow tube having a nozzle provided with reverse direction orifices to the opposite end of the flexible hose to receive the high pressure water from the flexible hose and to allow the high pressure water to exit from the reverse direction orifices; inserting the nozzle into the header until it emerges into the manifold cavity; activating the valve means to allow high pressure water to flow out said reverse direction orifices; and, finally pulling the nozzle out of the header.

In a further alternate embodiment, an apparatus is provided for cleaning the absorption column manifold which is the same as that used to clean the manifold headers except that there is no requirement for the use of the hollow tube. The manifold may be cleaned using this apparatus by inserting the nozzle into the manifold, opening the valve means sufficiently to create the necessary force to cause the nozzle to travel the desired length of the manifold and to cause the force from the high pressure water exiting the reverse direction orifices to remove scale which may have accumulated on the interior wall surface of the manifold.

PREFERRED EMBODIMENTS OF THE INVENTION

Figure 1:
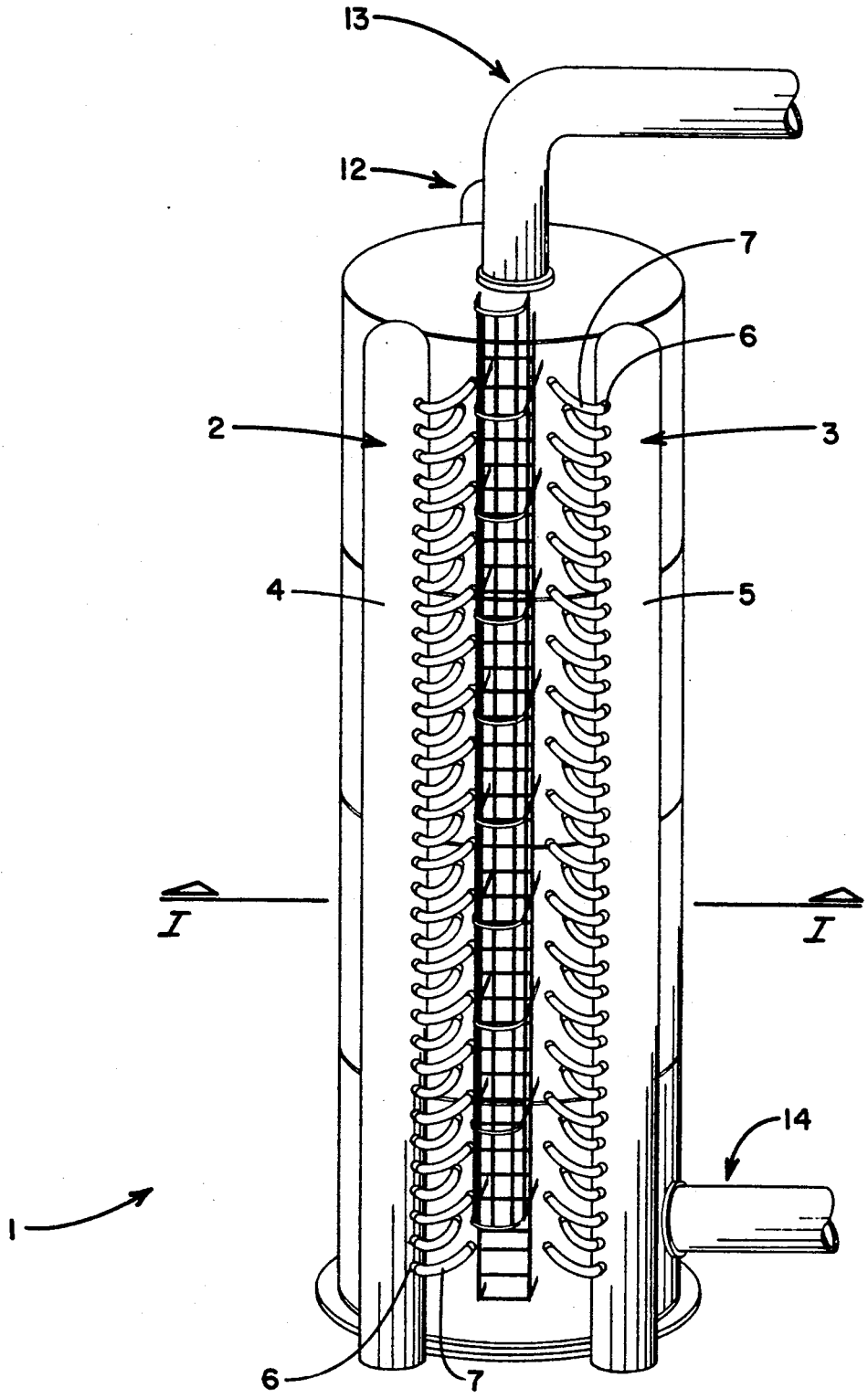
FIG. 1 is a three-dimensional view of one embodiment of a conventional absorption column.
Figure 2:
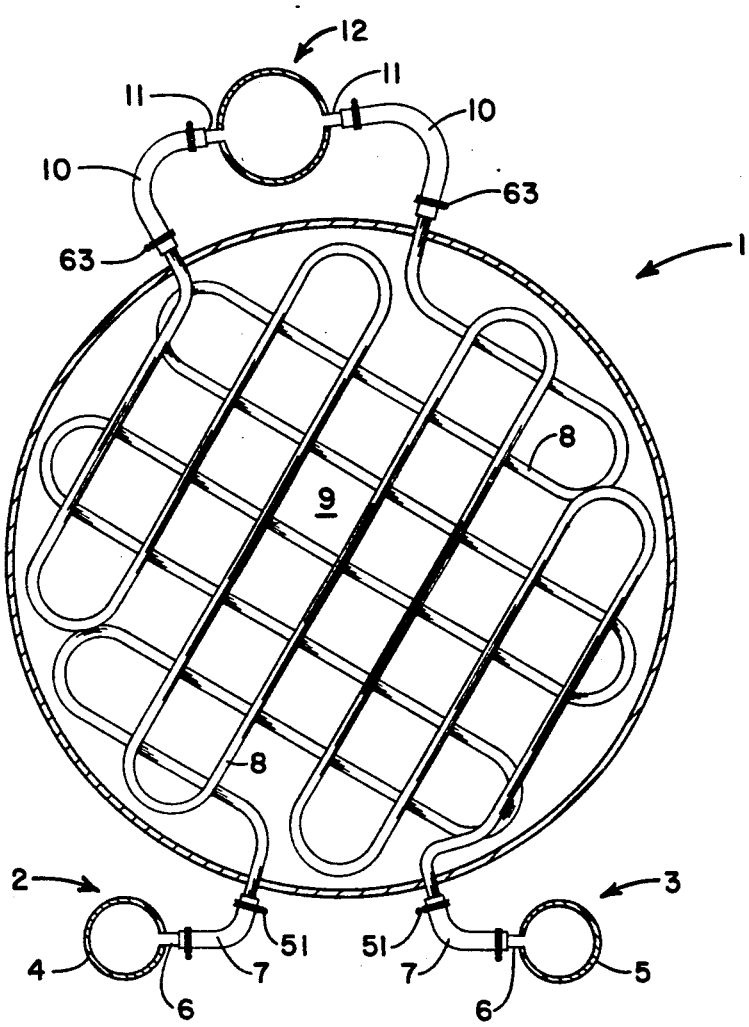
FIG. 2 is a cross-sectional view taken along line I—I of FIG. 1 disclosing the positioning of only two of the many coils in a typical sieve tray.

Referring to FIGS. 1 and 2, a conventional absorption column 1 is illustrated having fluid supply manifolds 2 and 3 which are connected at one end (not shown) to receive water from a water source. Protruding from the outside surfaces 4 and 5 of manifolds 2 and 3, respectively are headers 6 to which hoses 7 are connected. Hoses 7 are in turn connected to coils 8 that are configured in trays 9 located inside absorption column 1. Coils 8 exit outside absorption column 1 where they are connected to a second set of hoses 10 which in turn are connected to a second set of headers 11 protruding from fluid return manifold 12.

Absorption column 1 has fluid conduit 13 through which dilute nitric acid can be introduced to the top section of absorption column 1, typically through a sparger assembly (not shown), and fluid conduit 14 through which nitrous gases can be introduced to the bottom section of absorption column 1, typically through a second sparger assembly (not shown.)

In operation, water or other cooling fluid will be pumped from the water source to the fluid supply manifolds 2 and 3, and into coils 8 by Way of hoses 10. The water then exits coils 8 through hoses 10 and is returned to the water source (e.g., a cooling tower) by way of the fluid return manifold 12 and a fluid return conduit operatively connecting the manifold 12 to the cooling tower. While the water is circulating through coils 8 dilute nitric acid is sprayed from the sparger located in the top section of the column 1 and nitrous gases sprayed from the sparger located in the bottom section of the column 1. The mixing of the dilute nitric acid and nitrous gases within the column 1 causes a chemical reaction producing a more concentrated nitric acid and heat. The concentrated nitric acid is collected at the bottom of the column 1 and sent to storage by conventional means not shown. The heat generated is absorbed by the circulating water and thus removed from column 1. For the process to operate efficiently, it is necessary that the reaction conditions, including the temperature within the column, be controlled. When a sufficient number of coils 8 become plugged or begin leaking as a result of corrosion, then it is not possible to extract sufficient heat from within the column 1 during the reaction.

To alleviate this problem, it is desirable to unplug the plugged coils and replace or seal those which are leaking. The apparatus and methods of this invention are designed to help accomplish either or both of these functions.

Figure 3:
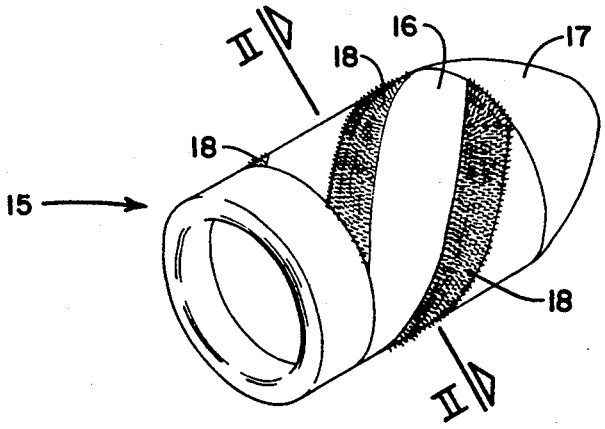
FIG. 3 is a perspective view of one preferred embodiment of the pig used with this invention.
Figure 4:
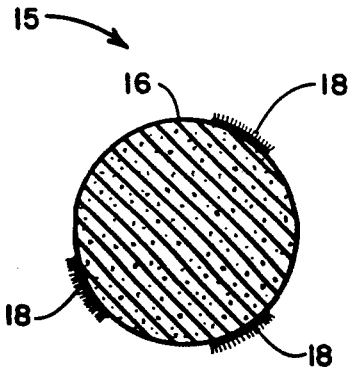
FIG. 4 is a cross-sectional view taken along lines II—II of FIG. 3 of the pig.

In a first aspect of this invention, a specially designed pig is utilized in the unplugging of coils 8. Referring to FIGS. 3 and 4, pig 15 comprises a cylindrical-shaped body 16 constructed of polyurethane foam or material having similar compressibility and lateral expansion characteristics. In a more preferred embodiment the nose section 17 of body 16 will be rounded to aid in movement through coils 8. Bands 18 of wire bristles are glued or otherwise fixedly attached about the outer surface of body 16, preferably in a spiral pattern as shown. In this preferred configuration the lateral expansion of the polyurethane foam and the positioning of the bands 18 minimizes the removal of the wire bristles as pig 15 is forced through coils 8. It is further preferred that the outside diameter of pig 15 be approximately one-sixteenth of one inch greater than the inside diameter of coils 8 being cleaned.

Figure 5:
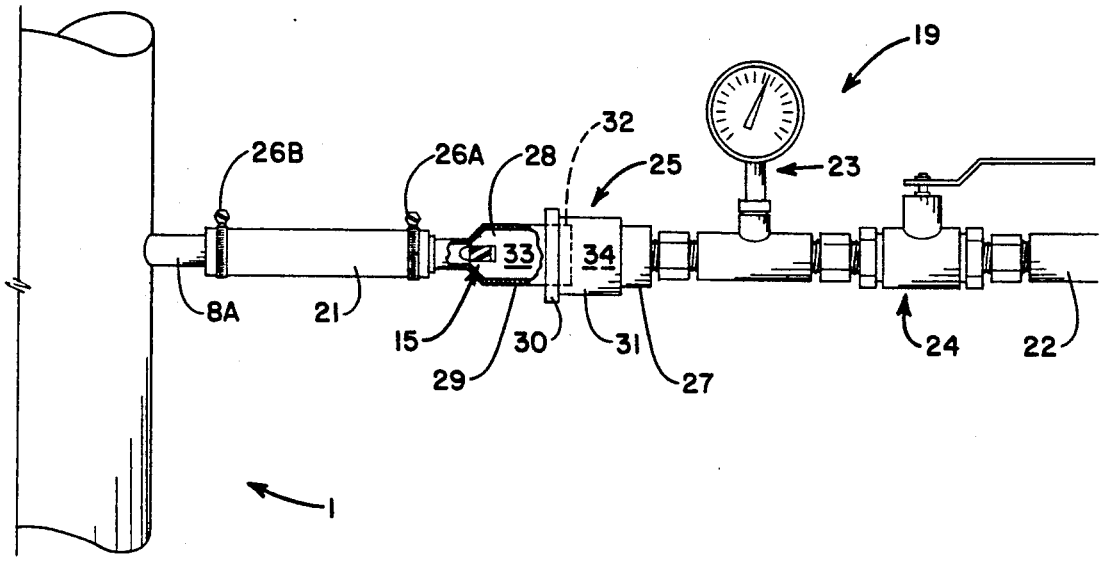
FIG. 5 is a perspective view of one preferred embodiment of the launching assembly of this invention.
Figure 6:
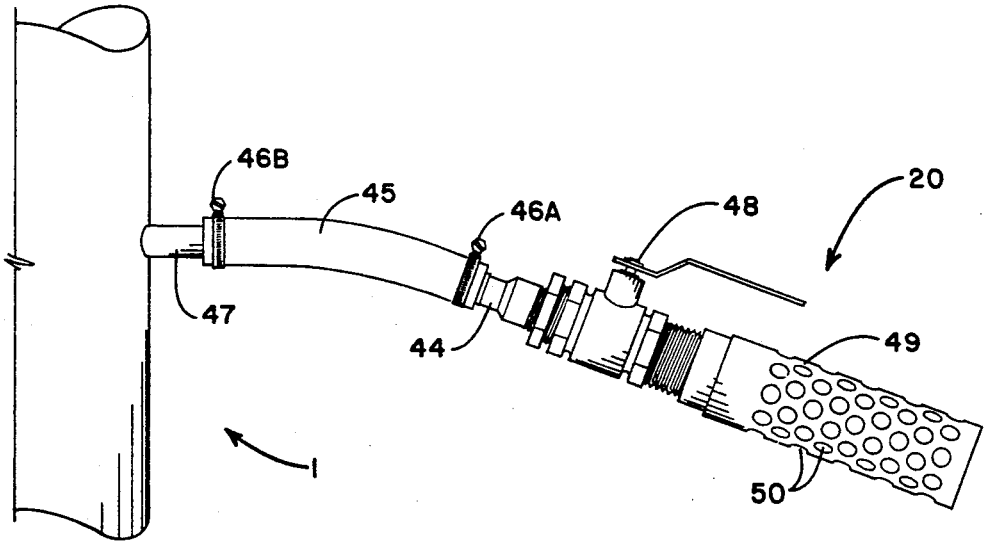
FIG. 6 is a perspective view of another preferred embodiment of the pig catcher assembly utilized to assist with hydrostatic coil tests, as well as coil cleaning.

In addition to pig 15, one utilizes a pig launcher assembly 19, such as shown in FIG. 5 which is connectable to a conventional high pressure water source (not shown), and a pig receiver assembly 20, such as shown in FIG. 6. Referring now to FIG. 5, pig launcher assembly 19 comprises flexible hosing 21 that attaches at one end to the particular header 6 of the coil 8 being cleaned. The other end of hosing 21 is connected to high pressure water line 22 having a pressure gauge 23 operatively mounted thereon to measure and visually indicate the water pressure in hosing 21. Operatively connected between pressure gauge 23 and high pressure water line 22 is cut-off valve 24 which can cut-off water flow to flexible hosing 21 when desired. Both pressure gauge 23 and cut-off valve 24 may be of any conventional construction which permits flow of water from high pressure water line 22 to flexible hosing 21.

In the embodiment of pig launcher assembly 19 shown in FIG. 5, a swage 25 is operatively connected by gear clamps 26 to flexible hosing 21 and pressure gauge tubing 27 to permit high pressure water to flow from tubing 27 through passageway 28 of launcher 25 to hosing 21. Swage 25 comprises a forward section 29 having a threaded hammer union 30 attached to the end facing the rear section 31 having a threaded end 32 to mattingly connect to hammer union 30 to form a seal through which the high pressure water will not leak. Both sections have cavities 33 and 34, respectively, that form passageway 28 when the two sections have been connected. Passageway 28 is of sufficient inside diameter and shape to permit pig 15 to be positioned in passageway 28 and be forced by the high water pressure into hosing 21.

In an alternate embodiment, swage 25 is removed and hose 21 is connected directly to pressure gauge tubing 27. Gear clamp 26A is then tightened to fix hose 21 to tubing 27 to prevent water leakage. In operation, pig 15 is first placed at least partially in the protruding end 8A of coils 8. Hose 21 is then fitted over both pig 15 and the protruding end 8A of coils 8. Gear clamp 26B is then tightened to fix hose 21 onto coil end 8A, and then the operation proceeds the same as if a swage 25 was in place.

If it is desired to permit continuous pump discharge of the water during the testing procedure a dual relief valve assembly 35 (See FIG. 7) can be used. Assembly 35 comprises tubing 36 which connects at one end 37 to manifold 38 connected to high pressure pump 39 and permits water flow to both relief valves 40 and 41. One outlet 42 of manifold 38 is operatively attached to cut-off valve 24 by hose 22 to permit water flow thereto. A second outlet 43 is operatively connected to one end of tubing 36 to permit high pressure water to flow to both relief valves 40 and 41. Attached to relief valve 40 is by-pass hose 44 that permits high pressure water to flow through relief valve 40 back to the water source. In a preferred embodiment, relief valve 40 is a 1,000 psig relief valve and relief valve 41 is a 1,500 psig relief valve.

Referring now to FIG. 6, a preferred embodiment of pig receiver assembly 20 is illustrated which can be used in both coil cleaning and leak detection procedures. Assembly 20 comprises nipple 44 to which flexible hose 45 is operatively attached by gear clamp 46A at one end and attached by gear clamp 46B at its other end to exit header 47 of the coil being cleaned and/or leak tested to permit both pig 15 and the high pressure water to flow through nipple 44, cut-off valve 48 (when opened) and into perforated receiver 49. The perforations 50 are sized to permit the water to flow through so as not to build up any back pressure, but not sufficiently large to permit pig 15 to pass through them.

Figure 7:
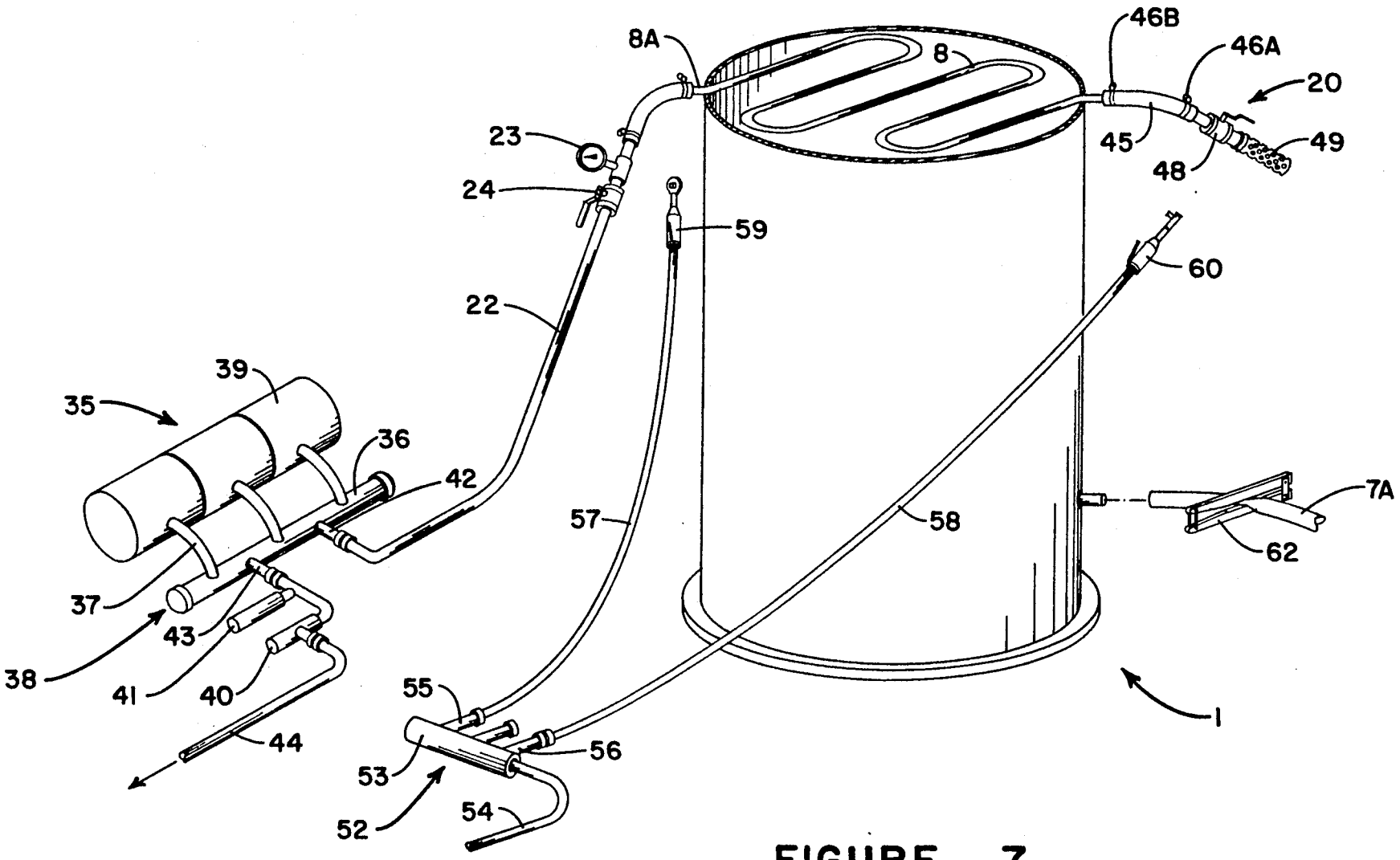
FIG. 7 is a perspective view of still another preferred embodiment of the launching assembly utilized with dual relief valves which permit the continuous pump discharge and which illustrates the use of air rachet wrenches for loosening and tightening the gear clamps utilized in connecting the flexible hosing used in the procedure.

When one desires to both hydrostatically test for leaks in coils 8 and then clean the coil, the apparatus of this invention is first connected to coils 8 in the following manner (See FIGS. 2 and 7). Water flowing to the particular coil being tested is diverted to other coils by the use of alligator clamp 62 to cut off the water supply flowing through the supply hose 7A. Supply hose 7A provides water to the particular coil being tested and/or cleaned. The clamps fixing hose 7A to coil end 8A is detached from coil end 8A. In a preferred embodiment, an air ratchet wrench assembly 52 is utilized to quickly loosen the bolts holding clamps 51 in place. More preferably, assembly 52 comprises a manifold 53 having an entry port 54 to receive air and at least two exit ports 55 and 56 to which are attached air hoses 57 and 58, respectively. Operatively attached to the opposite end of each air hose 57, 58 is an air ratchet wrench 59 and 60, respectively. Air hoses 57 and 58 are preferably of sufficient length to allow simultaneous attachment to the bolts of clamp 51 and the bolts of clamp 63 so that hoses 7 and 10, respectively, can be removed at the same time.

Pig 15 is now positioned for insertion into coils 8. If pig launcher assembly 19 without swage 25 is used, this is accomplished by twisting pig 15 partially into header 6. If pig launcher assembly 19 illustrated in FIG. 5 is used, pig 15 is first placed in cavity 33 and swage 25 assembled together by screwing hammer union 30 on threaded end 32. Flexible hosing 21 is then pushed over and sealingly clamped to header 6 to prevent water leakage during the cleaning operation. During this procedure cut-off valve 24 is closed to prevent any water flowing into header 6 or cavity 33. Water is pumped under pressure by pump 39 through line 22 to valve 24. It is preferred that the pressure at valve 24 be between 50 and 500 psig, more preferably about 100 psig initially. Valve 24 is opened subjecting pig 15 to the high pressure water which forces pig 15 to pass through coils 8. The wire bristle bands 18 will scrape off accumulated scale and similar material from the inside surface of coils 8, thus removing constrictions which are restricting the water flow through coils 8.

Already attached to return header 11 is pig receiver assembly 20 whose cut-off valve 48 is open to allow pig 15 and the high pressure water to exit coils 8. The water passes through perforations 50 while pig 15 is retained in receiver 49. This procedure may be repeated if desired. In the event that pig 15 should become stuck in coils 8, cut-off valve 24 is closed and flexible hosing 21 and 45 are reversed so that when cut-off valve 24 is opened high pressure water is forced through coils 8 in the opposite direction, thus, forcing pig 15 back out the way it came.

In another embodiment, if hard acid-soluble scale is encountered, coils 8 are connected together in series by hosing clamped to the supply headers 6 and return headers 11. Liquid acid or acid mist from an acid source is then circulated through coils 8 to pre-soften the scale before pig 15 is forced through coils 8. When the acid exits the last of coils 8 it is transferred back to the acid source to avoid any environmental problems.

If after pig 15 has been caught by receiver 49, one also desires to hydrostatically pressure test coils 8 to determine if there are any leaks, then cut-off valve 48 is closed. One then reads the pressure on pressure gauge 23 and then closes cut-off valve 24. During a pre-determined period of time one periodically observes the pressure readings to see if there has been any drop in the pressure. If so, this is an indication that the coil is leaking. If the leak is severe, then the coil can be replaced and taken out of the water flow system by clamping hoses 7 and 11 to and from that particular leaking coil.

If desired one could first test for leaks in a coil, and then if none found, one could clean the coil following the procedures set forth above.

Figure 8:
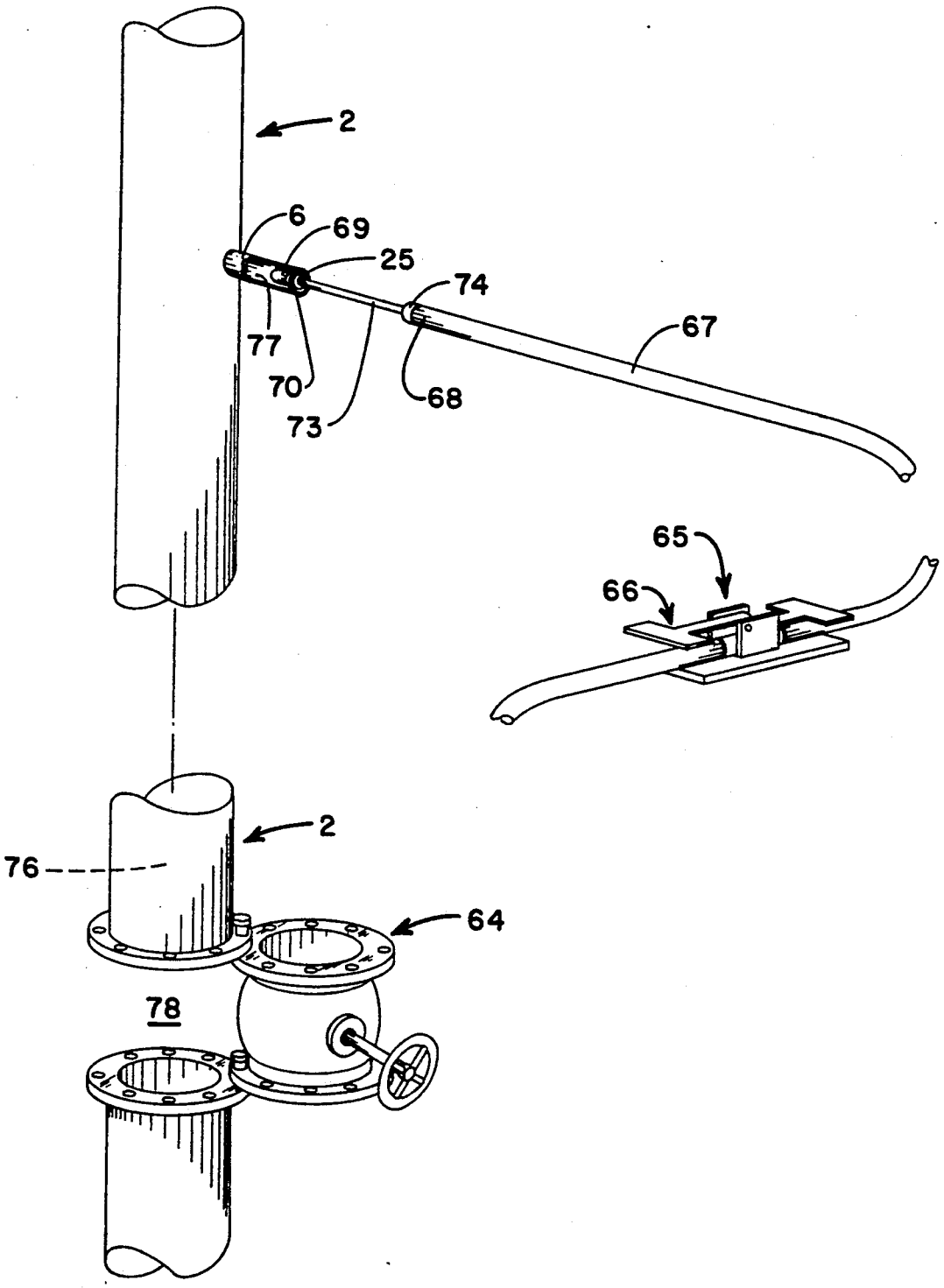
FIG. 8 is a perspective view of a preferred embodiment of the assembly utilized to unplug the vertical manifold, the manifold headers and the header hoses and having a foot control valve means.

It has been discovered that one of the problems with absorption columns has been the clogging of the manifold cavity 76, and, more importantly, the headers 6 and the hoses 7 connecting the headers to coils 8. Unless these are also unplugged and cleaned, the efficiency of the absorption column will be negatively effected. Referring now to FIG. 8, preferred embodiments of apparatus which can be used to solve this problem are shown. A partial cutaway of the vertical cooling fluid supply manifold 2 is illustrated wherein hose 7 attached to one end of header 6 has been disconnected from coils s to which it had been attached. At the lower end of manifold 2 cooling fluid control valve 64 is shown by the dotted lines in a "rolled-out" position. The apparatus and methods described to unplug and clean manifold 2 and its headers 6 could also be used to unplug and clean manifolds 3 and 12 and their headers 6, 11, respectively.

To clean manifold 2 a valve 65 having a foot operated shutoff assembly 66 is attached at one end to a high pressure water source. To its opposite end, a flexible hose 67 is operatively attached to receive the high pressure water. At end 68 of hose 67 is nozzle 69 having reverse direction orifices 70 positioned to direct the high pressure water downward and outward from hose 67 and in a direction to cause the high pressure water to strike the interior wall surface 72 forming the manifold cavity 76. In operation, cooling fluid to manifold 2 is shut-off and valve 64 is pivoted on bolts 71 in a position to allow nozzle 69 to be inserted into manifold 2. With nozzle 69 inserted part way into manifold cavity 76, valve 65 is activated closing a by-pass causing pressure to build up in nozzle 69 and discharge through reverse direction orifices 70, thus providing a cutting action. The force of the high pressure water will cause nozzle 69 and its attached hose 67 to travel upward into manifold cavity 76 cutting scale from the interior surface 72 of manifold 2 and blowing cuttings out of manifold 2 at the position that valve means 64 has been pivoted or rolled-out from manifold 2. To prevent the removed scale from falling into that section 79 of the manifold cavity 76 located below opening 80 created by pivoting valve means 64, a shield means 81 is positioned over the top of section 79 to block the removed scale from falling into cavity section 79.

To unplug and clean headers 6, a hollow rigid tube 73 is attached to flexible hose end 74 and nozzle 69 is attached to the opposite end 75 of tube 73. In a preferred embodiment, tube 73 will be of length greater than that of the length of header 6 so that it can be inserted through header 6 and into manifold 2. As before, cooling fluid circulation through manifold 2 is stopped. Hose 7 is disconnected from coils 8. Nozzle 69 is attached to tube 73 which in turn is attached to hose 67. Nozzle 69 is then inserted through header 6 and into manifold 2. The foot operated valve 65 is activated as described above to allow high pressure water to pass through hose 67, tube 73, nozzle 69 and then out through reverse direction orifices 70. The tube 73 with the high pressure water exiting through reverse direction orifices 70 is pulled back through header 6. Once tube 73 has been pulled back through header 6 a sufficient distance to allow the high pressure water stream to unplug header 6, valve 65 is activated by the foot-operated cut-off assembly 66 to open a by-pass and, thus, release the high pressure water performing the work. This method results in scale and other matter being removed from clogged header 6. In this operation one must be careful not to allow the high pressure water stream to strike hose 7 as it would cut through hose 7. Thus, it is preferred that hose 7 be disconnected from header 6 before nozzle 69 is inserted into header 6. Upon the completion of cleaning header 6, hose 7 is reconnected to header 6.

In an alternate embodiment, headers 6 and hose 7 can be unplugged utilizing a forward direction nozzle 69 having orifices that direct the high pressure water forward and outward at an angle from nozzle 69 to cause the high pressure water to strike the interior wall surface 77 of the header 6. In this configuration valve means 64 should be pivoted or rolled out so that any scale or other matter removed from headers 6 can be trapped and removed from manifold cavity 76 through the opening 78 created by the rolled out valve means 64.

It has been found that water pressure of 5,000 to 7,000 psig in conjunction with orifice sizes of about 0.031 to 0.078 inches in diameter will be sufficient to remove the scale and other material from manifold wall surface 76 and header wall surfaces 77.

There are, of course, other alternate embodiments which are obvious from the foregoing descriptions of the invention which are intended to be included within the scope of the invention as defined by the following claims.

What I claim is:

1. A method of cleaning a nitric acid absorption column cooling coil which has multiple 180° bends and provided at each end with an access port and an exit port comprising:

(a) closing said access port;

(b) inserting a pig in an operative position within a sealable cavity of a launching assembly which is operatively attached to said access port to allow said pig to enter within said coil;

(c) pressurizing said launching assembly with a fluid to a pre-determined level;

(d) opening said access port while maintaining said level of pressure against said pig during its movement through said coil by a fluid pump sufficient to force said pig into and through said coil; and (e) capturing said pig after it passes through said exit port.

2. A method according to claim 1 wherein (a) prior to insertion of said pig into said cavity, closing said exit port;

(b) operatively attaching said launching assembly to said access port to allow fluid to be pumped through said access port and into said coil;

(c) closing said access port;

(d) by a pressure gauge operatively attached to said coil to measure the pressure within said coil, measuring the pressure in said coil over a pre-determined period of time to determine if any drop in the pressure occurs during said period of time; and (e) after said pre-determined period of time opening said exit port.

3. A method according to claim 1 wherein said pressure is 50–100 psig.

4. A method according to claim 1 further comprising:

(f) opening a pressure relief valve operatively connected to said coil to measure pressure within said coil in the event the pressure within said coil exceeds a predetermined level.

5. A method according to claim 1 wherein said pig comprises:

(a) a substantially, cylindrical-shaped body constructed of compressible material, wherein one end of said body is conically-shaped and whose diameter is about 1/16 of an inch longer than the inside diameter of said coil; and (b) a band of wire brush spirally wrapped about a portion of said body.

6. A method of cleaning a nitric acid absorption column having one or more coils each having multiple 180° bends containing restrictions caused by acid-soluble scale buildup wherein each of said coils has an access port and an exit port comprising:

(a) connecting said access ports and said exit ports with hosing section to form a single passageway through said coils;

(b) operatively connecting one of said exit ports to a source of acid capable of dissolving said scale buildup;

(c) operatively connecting one of said access ports to said source;

(d) utilizing pumping means to circulate said acid from said source to said one of said access ports, then through said coils, then out said one of said exit ports, and then back to said source until sufficient amounts of said scale buildup has been dissolved and removed from said coils by said circulating acid to allow a pig to pass through said coils;

(e) disconnecting said exit ports and said access ports to allow fluid to flow through said coils in parallel;

(f) closing one of said access ports;

(g) inserting a pig in an operative position within a sealable cavity of a launching assembly which is operatively attached to said closed access port to allow said pig to enter within said coil corresponding to said closed access port when said access port is open;

(h) pressurizing said launching assembly with a fluid to a pre-determined level;

(i) opening said closed access port while maintaining said level of pressure against said pig during its movement through said coil by a fluid pump sufficient to force said pig into and through said coil;

(j) capturing said pig after it passes through said exit port corresponding to said access port;

(k) repeating steps (f) through (j) for each coil to be cleaned.

7. A method according to claim 6 wherein (a) prior to insertion of said pig into said cavity, closing said exit port;

(b) operatively attaching said launching assembly to said access port to allow fluid to be pumped through said access port and into said coil;

(c) closing said access port;

(d) by a pressure gauge operatively attached to said coil to measure the pressure within said coil, measuring the pressure in said coil over a pre-determined period of time to determine if any drop in the pressure occurs during said period of time; and (e) after said pre-determined period of time opening said exit port.

* * * * *